US008080752B2

(12) United States Patent
Levi

(10) Patent No.: US 8,080,752 B2
(45) Date of Patent: Dec. 20, 2011

(54) CONTROL ASSEMBLY FOR INTERLOCKED SOCKETS

(75) Inventor: Bruno Levi, Brescia (IT)

(73) Assignee: Palazzoli, S.p.A. (IT)

( * ) Notice: Subject to any disclaimer, the term of this patent is extended or adjusted under 35 U.S.C. 154(b) by 16 days.

(21) Appl. No.: 12/310,091

(22) PCT Filed: May 19, 2008

(86) PCT No.: PCT/EP2008/003994
§ 371 (c)(1),
(2), (4) Date: Feb. 10, 2009

(87) PCT Pub. No.: WO2008/141788
PCT Pub. Date: Nov. 27, 2008

(65) Prior Publication Data

US 2010/0065407 A1 Mar. 18, 2010

(30) Foreign Application Priority Data

May 24, 2007 (IT) ..... MI2007A1054

(51) Int. Cl.
*H01H 9/00* (2006.01)

(52) U.S. Cl. ..... 200/316

(58) Field of Classification Search ..... 200/316, 200/313, 310, 308, 11 R
See application file for complete search history.

(56) References Cited

U.S. PATENT DOCUMENTS

| | | | | | |
|---|---|---|---|---|---|
| 2,693,165 | A | * | 11/1954 | Appleman | 200/316 |
| 2,694,760 | A | * | 11/1954 | Laylon | 200/316 |
| 3,217,439 | A | | 11/1965 | Wilhelmi | |
| 3,260,830 | A | * | 7/1966 | Albright | 200/316 |
| 4,131,033 | A | * | 12/1978 | Wright et al. | 200/316 |
| 5,680,926 | A | | 10/1997 | Sandor et al. | |
| 6,410,868 | B1 | | 6/2002 | Berlemont et al. | |

FOREIGN PATENT DOCUMENTS

| | | | |
|---|---|---|---|
| CA | 2141084 | | 1/1995 |
| DE | 44 47 493 | A1 | 12/1995 |
| EP | 0 853 269 | A | 7/1998 |
| EP | 1 075 055 | A | 2/2001 |
| GB | 960693 | A | 6/1964 |
| GB | 2292488 | A | 2/1996 |

* cited by examiner

*Primary Examiner* — Felix O Figueroa
(74) *Attorney, Agent, or Firm* — R. Neil Sudol; Harry D. Coleman; William J. Sapone

(57) ABSTRACT

A control assembly for interlocked sockets includes a rotary breaker which is actuated by a knob and is mounted on a supporting structure. The control assembly includes a visual indication means which has the purpose of highlighting the open/closed state of the rotary breaker as a consequence of rotations of the knob.

11 Claims, 5 Drawing Sheets

CONTROL ASSEMBLY FOR INTERLOCKED SOCKETS

BACKGROUND OF THE INVENTION

The present invention relates to a CONTROL ASSEMBLY for interlocked sockets.

As is known, the operations for opening and closing circuits in industrial electrical systems are very often performed by using a rotary switchgear assembly, substantially constituted by a breaker of the rotary type controlled by a knob which, in compliance with specific standards, is provided with an indicator which points to a "0" symbol when the breaker is in the open state or to an "I" symbol when the breaker is in the closed state.

A rotary switchgear is characterized by considerable flexibility in use; in addition to being used as disconnectors in low-voltage industrial electrical systems, they in fact usually are an integral part of interlocked sockets. In order to ensure the safety of operators and the integrity of all high tension devices, the interlocked sockets include locking devices, of the mechanical or electrical type, which are connected to breaking devices, constituted in the specific case very often by rotary switchgear, in order to ensure that plugs cannot be inserted or removed in the presence of current.

Regardless of what may be their application, the main drawback of conventional rotary switchgears is that the color of the knob and its indicator and the color of the background on which the "0" and "I" symbols are marked often coincide, at a distance or in low light it can be difficult to understand unequivocally whether the breaker is in the open state or in the closed state.

OBJECTS OF THE INVENTION

The aim of the invention is to solve the problems described above by providing a control assembly for interlocked sockets, in which the state of the breaker is clearly visible even at a considerable distance, both when the switchgear is incorporated within an interlocked socket and when it is used as a disconnector breaker in an electrical system.

Within the scope of this aim, a particular object of the invention is to provide a control assembly in which the state of the breaker is clearly visible even in low light.

A further object of the invention is to provide a control assembly which is simple to manufacture and is advantageous from a purely economic standpoint.

This aim and these and other objects, which will become better apparent hereinafter, are achieved by a control assembly for interlocked sockets, comprising a rotary breaker which is actuated by a knob and is mounted on a supporting structure, characterized that it comprises a visual indication means for highlighting the open/closed state of said rotary breaker, said visual indication means being detectable as a consequence of the rotation of said knob.

BRIEF DESCRIPTION OF THE DRAWINGS

Further characteristics and advantages will become better apparent from the description of preferred but not exclusive embodiments of an item of a control assembly according to the invention, illustrated by way of non-limiting example in the accompanying drawings, wherein.

DETAILED DESCRIPTION OF PREFERRED EMBODIMENTS

Figure 1:
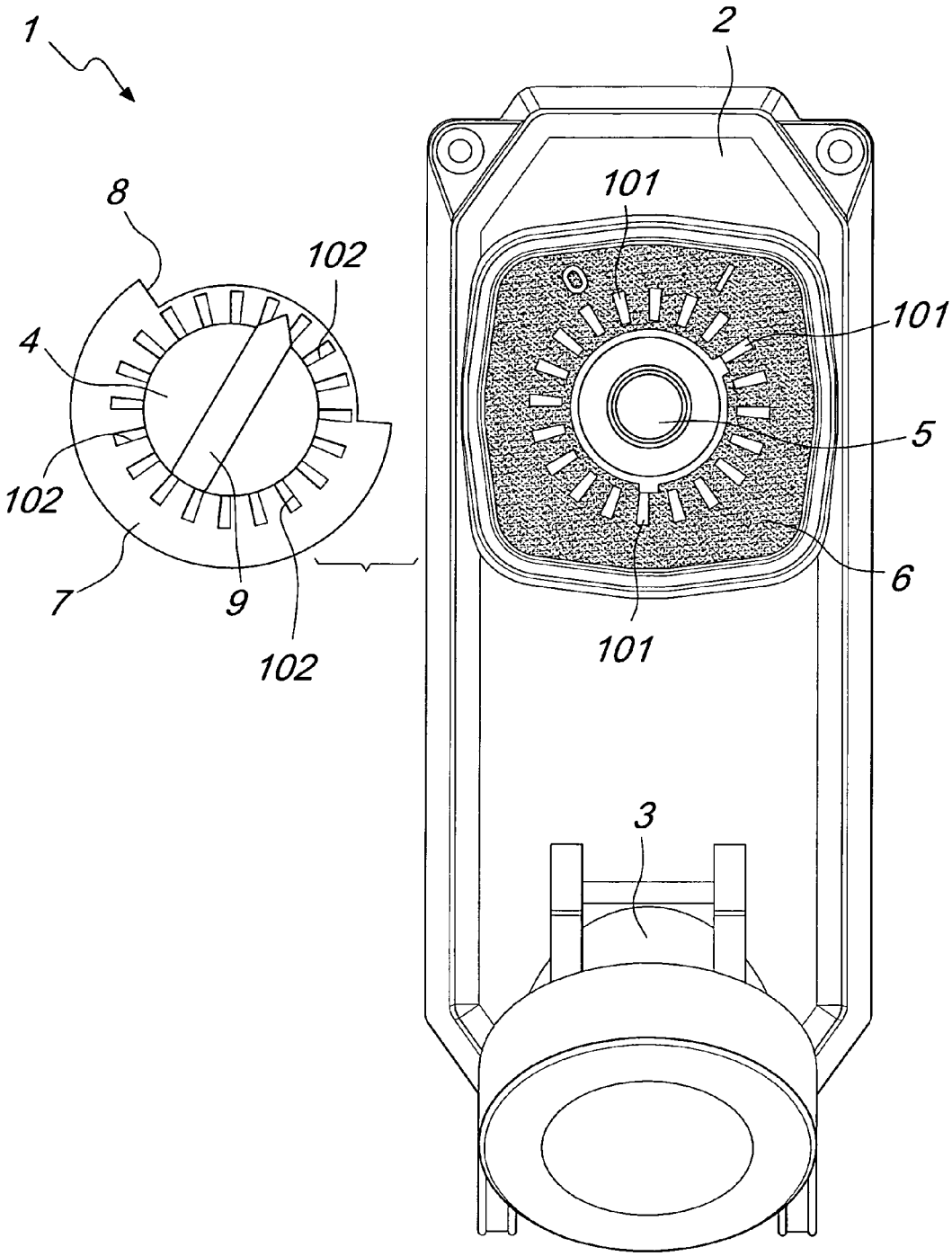
FIG. 1 is a front view of a rotary control assembly in a disassembled condition, incorporated within an interlocked socket.
Figure 2:
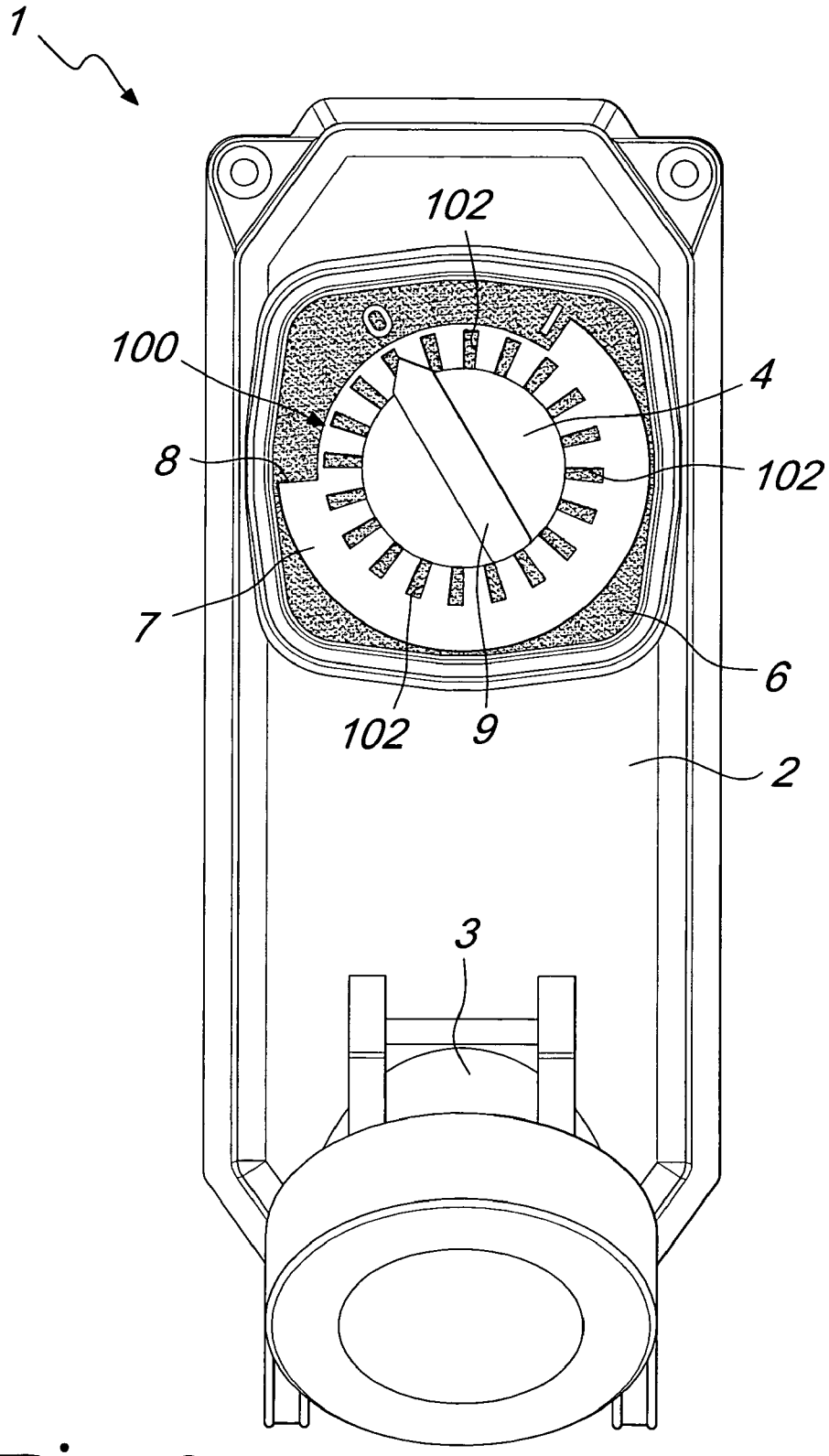
FIG. 2 is a front view of a control assembly incorporated in an interlocked socket, with the assembly in the open position.
Figure 3:
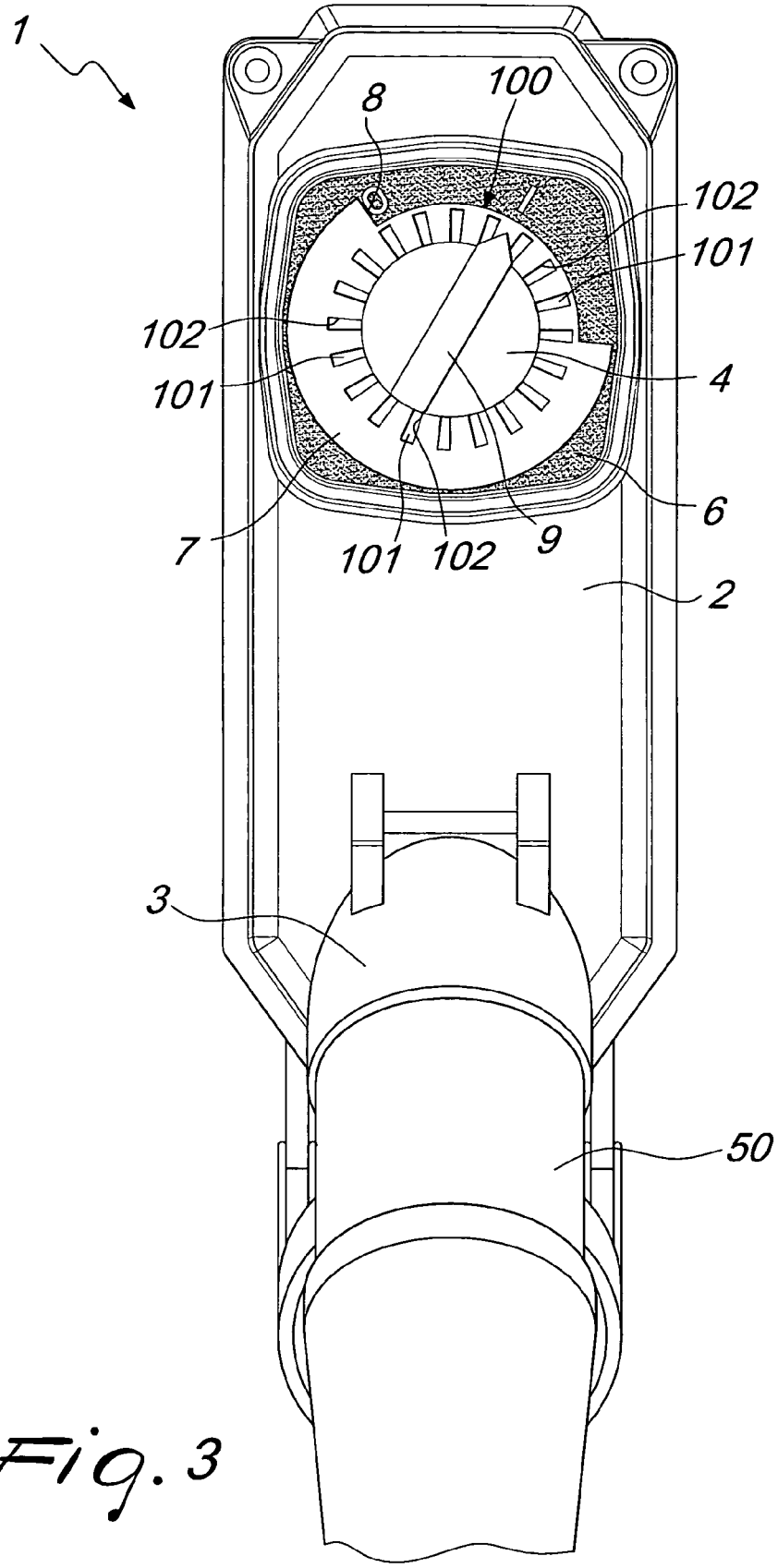
FIG. 3 is a front view of a control assembly incorporated in an interlocked socket, with a plug inserted and with the assembly in the closed position.

With reference to the cited FIGS. 1 to 3, the control assembly is incorporated in an interlocked socket, generally designated by the reference numeral 1, which includes a supporting structure 2, made of insulating, impact-resistant and self-extinguishing polymer, on which a switchgear, not shown in the accompanying figures, and a socket 3 are fitted.

The switchgear is actuated by a knob 4 and is connected to the socket 3 by means of a safety device, not shown in the accompanying figures. In per se known manners the safety device prevents the socket 3 from becoming live prior to complete insertion of a plug 50 and prevents the disengagement of the plug 50 if the socket 3 is still live.

According to the invention, the rotary switchgear incorporated in the interlocked socket 1 has a visual indication means 100 which highlights the open/closed state of the item of rotary switchgear and can be detected as a consequence of rotations of the knob 4.

Namely, the visual indication means 100 includes a ring of colored areas 101 and ring of openings 102. The ring of colored areas 101 correspond to symmetrical sectors of a ring which is concentric with respect to the fitting point 5 of the knob 4. The symmetrical sectors are formed on a plate 6 which is associated with the supporting structure 2.

The ring of openings 102 correspond to symmetrical sectors of a ring which is concentric with respect to the knob 4; the sectors are formed on a circular screen 7 which is monolithic with the knob 4.

While the color of the colored areas 101, which may optionally be luminescent, necessarily must strongly contrast against the background color of the plate 6, the color of the knob 4 can substantially correspond to the background color of the plate 6 or can substantially correspond to the color of the colored areas 101.

Preferably, the openings 102 substantially conform to the colored areas 101 and are formed so that rotations of the knob 4, meant to induce a change in the open/closed state of the rotary switch, make the openings 102 affect the colored areas 101, making them visually detectable.

Preferably, on the circular screen 7, a contoured portion 8 is formed symmetrically with respect to the indicator 9 of the knob 4 in order to avoid interference with the ordinary indications of the open/closed state of the control assembly which are present on the plate 6 according to the indications of the relevant standards, which correspond to the "0" and "I" symbols.

Figure 4:
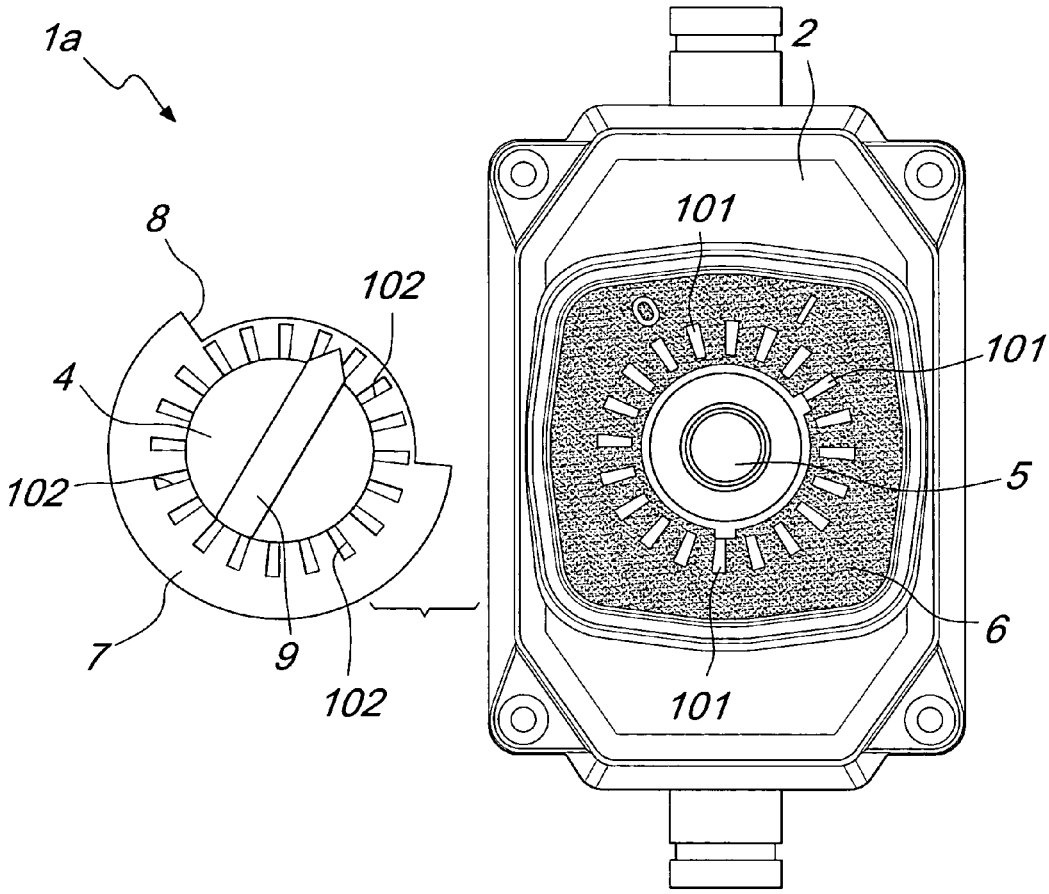
FIG. 4 is a front view of a control assembly in a disassembled condition and used as a disconnector breaker.
Figure 6:
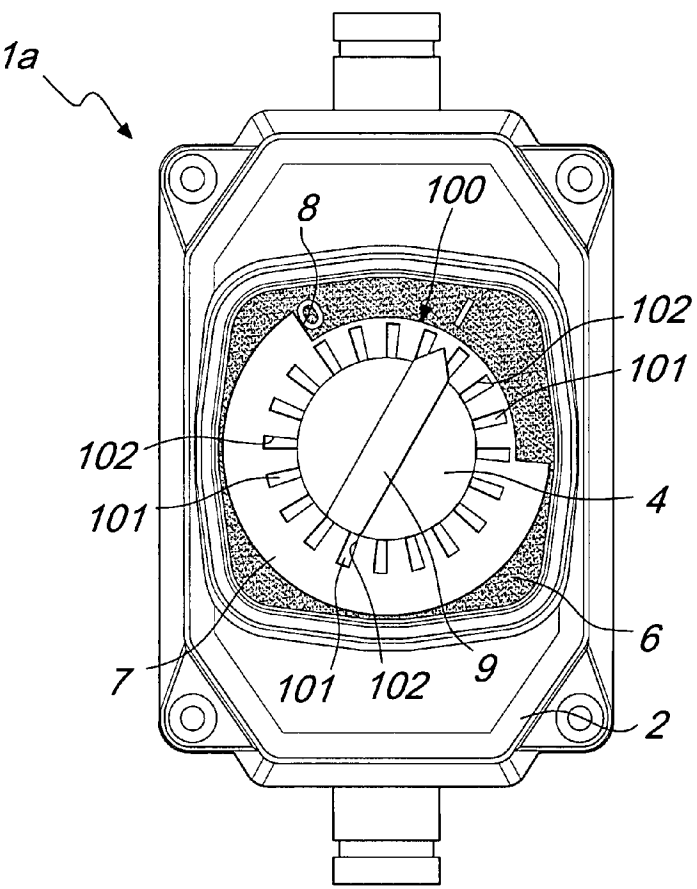
FIG. 6 is a front view of a control assembly used as disconnector breaker, with the assembly in the closed position.
Figure 5:
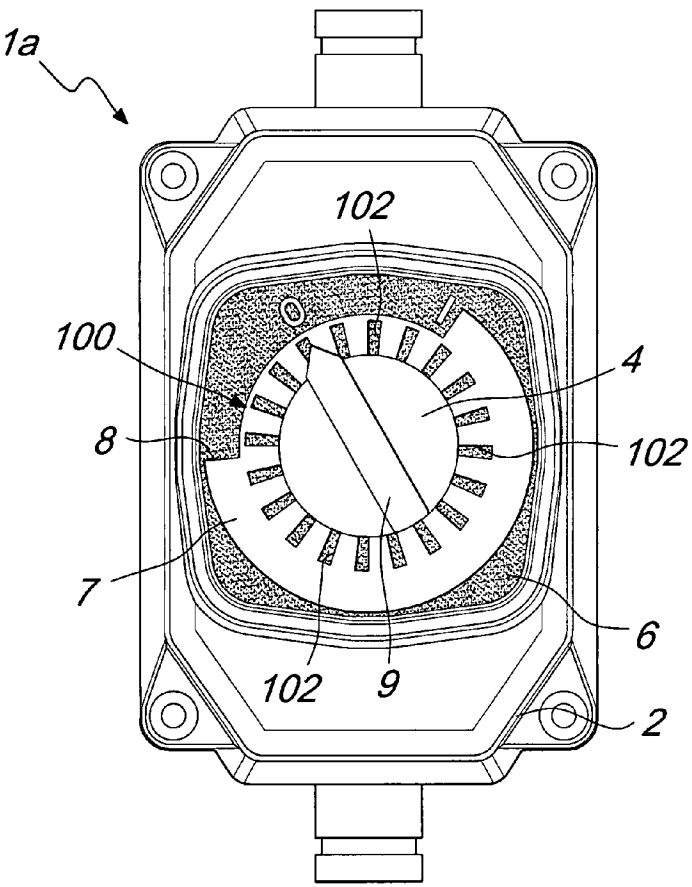
FIG. 5 is a front view of a control assembly used as disconnector breaker, with the assembly in the open position.

In the embodiment shown in FIGS. 4 to 6, the control assembly is used in a disconnector breaker, generally designated by the reference numeral 1*a*, which includes a supporting structure 2, which is conveniently made of insulating, impact-resistant and self-extinguishing polymer, and on which a rotary breaker, not shown in the accompanying figures and actuated by a knob 4, is fitted.

According to the invention, the assembly comprises the visual indication means 100 which highlights the open/closed state of the rotary breaker and is detectable as a consequence of rotations of the knob 4.

In the embodiment shown in FIGS. 4 to 6, the elements that correspond to the elements that have already been described with reference to the embodiment shown in FIGS. 1 to 3 have been designated by the same reference numerals.

The operation of the control assembly for interlocked sockets according to the invention is evident from what has been described and illustrated for both embodiments.

In particular it is evident that when the knob 4 is correctly fitted on the supporting structure 2, at the mounting point 5, and the rotary breaker is in the open state, with the indicator 9 which indicates the "0" symbol, the openings 102 simply affect areas of the plate 6.

Vice versa, if the rotary breaker is in the closed state, with the indicator 9 which indicates the "I" symbol and, with reference to the first embodiment, a plug 50 is inserted in the socket 3, the openings 102 affect the colored areas 101, making them visually detectable, even at a certain distance from the interlocked socket 1 or from the disconnector breaker 1*a*.

Accordingly, regardless of whether the color of the knob 4 substantially corresponds to the background color of the plate 6 or substantially corresponds to the color of the colored areas 101, the open/closed state of the rotary breaker is clearly indicated by the visual indication means 100 upon rotations of the knob 4.

In practice it has been found that the control assembly for interlocked sockets according to the invention fully achieves the intended aim. Being producible with modest costs, the control assembly ensures excellent visibility of the state of the switchgear, both at great distances and in low light, and both when the switchgear is incorporated within an interlocked socket and when it is used as a disconnector breaker in an electrical system.

This application claims the priority of Italian Patent Application No. MI2007A001054, filed on May 24, 2007, the subject matter of which is incorporated herein by reference.

What is claimed is:

1. Control assembly for interlocked sockets, comprising a rotary breaker which is actuated by a knob and is mounted on a supporting structure, further comprising a visual indication means for highlighting the open/closed state of said rotary breaker, wherein said visual indication means is detectable as a consequence of the rotation of said knob, said visual indication means comprising a ring of colored areas formed on said supporting structure at the mounting point of said knob, said colored areas corresponding to symmetrical sectors of a ring which is concentric with respect to said knob, said symmetrical sectors being formed on a plate which is associated with said supporting structure at the mounting point of said knob, wherein the color of said colored areas and the color of said plate contrast with respect to each other, said visual indication means further comprising a ring of openings formed in said knob, said openings affecting said colored areas as a consequence of rotations of said knob which are suitable to induce a change of the open/closed state of said rotary breaker, said openings corresponding to symmetrical sectors of a ring which is concentric with respect to said knob and being formed on a circular screen which is joined monolithically to said knob, said openings substantially conforming to said colored areas, said circular screen having a contoured edge portion which differs from said openings and is formed symmetrically about an indicator element of said knob.

2. Control assembly according to claim 1, wherein said colored areas are luminescent.

3. Control assembly for interlocked sockets, comprising a rotary breaker which is actuated by a knob and is mounted on a supporting structure, further comprising a visual indication means for highlighting the open/closed state of said rotary breaker, wherein said visual indication means is detectable as a consequence of the rotation of said knob, said visual indication means comprising a ring of mutually spaced colored areas formed on a plate associated with said supporting structure at the mounting point of said knob, said colored areas all having a first color and said plate having a second color that contrasts with respect to said first color, said visual indication means further comprising a ring of mutually spaced openings formed in a screen portion of said knob, said openings being alignable with respective ones of said colored areas as a consequence of rotations of said knob which are suitable to induce a change of the open/closed state of said rotary breaker, said screen portion of said knob having a color taken from the group consisting of said first color and said second color.

4. Control assembly according to claim 3 wherein said colored areas correspond to symmetrical sectors of a ring which is concentric with respect to said knob, said openings also corresponding to symmetrical sectors of a ring which is concentric with respect to said knob, said screen portion of said knob being circular screen and joined monolithically to said knob, said openings substantially conforming to said colored areas.

5. Control assembly according to claim 3, wherein said colored areas are luminescent.

6. Control assembly according to claim 3, wherein said knob has an indicator element and wherein said screen portion has an edge contour formed symmetrically about said indicator element of said knob.

7. Control assembly for interlocked sockets, comprising a rotary breaker which is actuated by a knob provided with an indicator and is mounted on a supporting structure, further comprising a visual indication means for highlighting the open/closed state of said rotary breaker, wherein said visual indication means is detectable as a consequence of the rotation of said knob, said visual indication means comprising a ring of colored areas formed on said supporting structure at the mounting point of said knob, the color of said colored areas and the color of said plate contrasting with respect to each other, said visual indication means further comprising a ring of openings formed in a screen portion of said knob, said openings affecting said colored areas as a consequence of rotations of said knob which are suitable to induce a change of the open/closed state of said rotary breaker said screen portion being a circular screen provided with an edge contour or cutout different from said openings and formed symmetrically at said indicator of said knob.

8. Control assembly according to claim 7, wherein said colored areas correspond to symmetrical sectors of a ring which is concentric with respect to said knob, said symmetrical sectors being formed on a plate which is associated with said supporting structure at the mounting point of said knob.

9. Control assembly according to claim 8, wherein said openings correspond to symmetrical sectors of a ring which is concentric with respect to said knob and are formed on a circular screen which is joined monolithically to said knob, said openings substantially conforming to said colored areas.

10. Control assembly according to claim 7, wherein said colored areas are luminescent.

11. Control assembly according to claim 7, wherein said colored areas are mutually spaced in a circumferential direction and wherein said openings are mutually spaced in a circumferential direction.

* * * * *